United States Patent [19]

Barch et al.

[11] Patent Number: 4,466,151

[45] Date of Patent: Aug. 21, 1984

[54] APPLICATOR FOR APPLYING A COATING TO A SURFACE

[75] Inventors: Herbert W. Barch, Natrona Heights; Emil Martin; S. Thomas Greer, both of Pittsburgh, all of Pa.

[73] Assignee: PPG Industries, Inc., Pittsburgh, Pa.

[21] Appl. No.: 394,029

[22] Filed: Jun. 30, 1982

[51] Int. Cl.[3] ..... B05D 5/02

[52] U.S. Cl. ..... 15/209 D; 15/227; 15/230.11; 29/110.5; 29/120; 29/121.8; 29/132

[58] Field of Search ..... 15/209 R, 209 C, 209 D, 15/210 R, 230.11; 29/110.5, 121.8, 120, 132

[56] References Cited

U.S. PATENT DOCUMENTS

| | | | |
|---|---|---|---|
| 2,983,940 | 4/1961 | Beyer-Olsen | 15/181 |
| 3,183,578 | 5/1965 | Kennedy, Jr. | 29/120 |
| 3,441,355 | 4/1969 | Brown | 401/219 |
| 3,605,165 | 9/1971 | Burns | 15/210 |
| 3,611,469 | 10/1971 | Belli | 15/118 |
| 3,614,801 | 10/1971 | Peabody | 15/179 |
| 3,648,322 | 3/1972 | Meisner | 15/257.05 |
| 3,662,446 | 5/1972 | Walls | 29/130 |
| 3,717,896 | 2/1973 | Chase et al. | 15/210 R |
| 3,728,755 | 4/1973 | Whalen | 15/210 R |
| 3,736,616 | 6/1973 | Seip | 15/210 R |
| 3,745,605 | 7/1973 | Gitschel et al. | 15/400 |
| 3,763,533 | 10/1973 | Blom et al. | 29/132 |
| 3,774,278 | 11/1973 | Ashton | 29/116 R |
| 3,815,197 | 6/1974 | Sukenik | 29/132 |
| 3,821,829 | 7/1974 | Finnerty | 15/244 R |
| 3,837,988 | 9/1974 | Hennen et al. | 161/67 |
| 3,852,862 | 12/1974 | Sukenik | 29/132 |
| 3,955,260 | 5/1976 | Sherden | 29/121 R |
| 4,191,792 | 3/1980 | Janssen | 427/260 |
| 4,228,208 | 10/1980 | Smith et al. | 428/95 |

OTHER PUBLICATIONS

Industrial Brushing, PPG Industries, Inc., Catalog 76-W.

*Primary Examiner*—Chris K. Moore

*Attorney, Agent, or Firm*—Kenneth J. Stachel

[57] ABSTRACT

Coating compositions can be applied to substrates to produce a smooth finish by the use of a coating applicator having a mat of sized glass fibers and/or strands having fibers and/or strands projecting from the surface of the mat. The coating applicator has a core with two surfaces, a mat of sized glass fibers with projecting fibers and/or strands attached to one surface of the core. The glass fibers within the strands have a residue of a sizing composition having a carrier, a film forming polymer, and compatible coupling agent. The glass fibers within the strand may be selected from bulked, texturized, hollow, hollow with etching and solid continuous and staple glass fibers and mixtures thereof. The thickness of the mat on the core to comprise the applicator is in the range of about 0.125 to about 2 inches (3 to 50 mm.).

30 Claims, 6 Drawing Figures

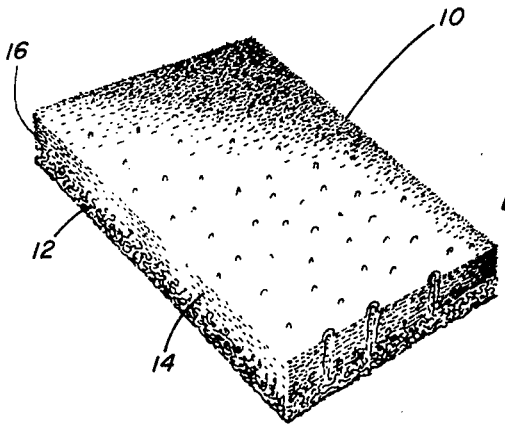
FIG. 1
FIG. 3A
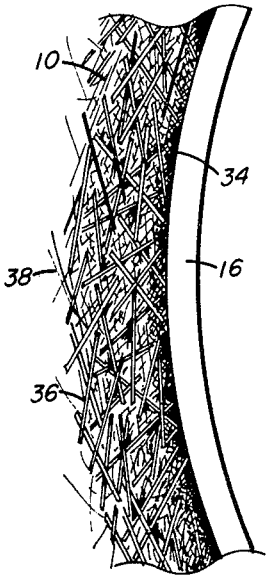
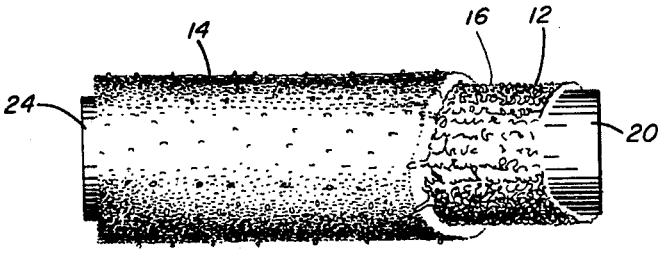
FIG. 2
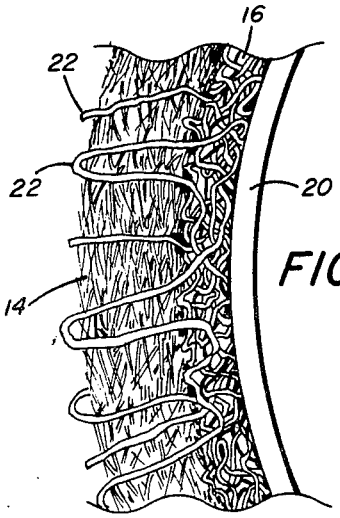
FIG. 3
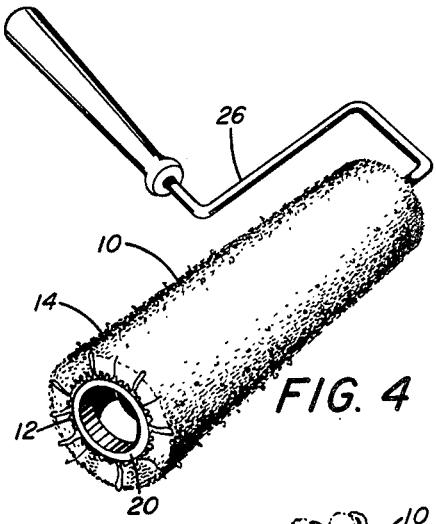
FIG. 4
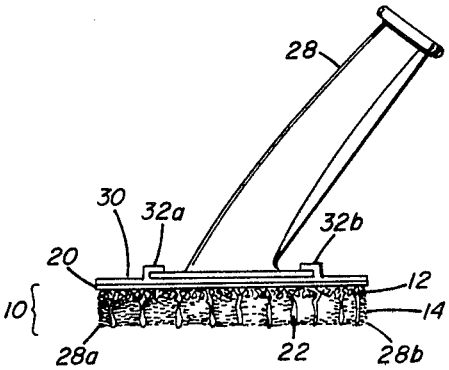
FIG. 5
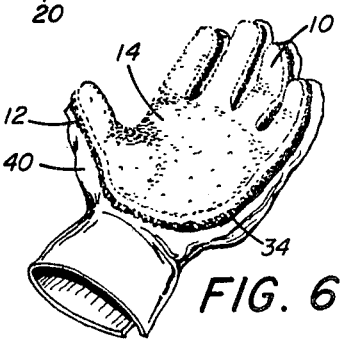
FIG. 6

APPLICATOR FOR APPLYING A COATING TO A SURFACE

The present invention is directed to an applicator such as a pad or roller applicator for applying coatings of varying viscosities to substrates to achieve a more uniform finish of the coating on the substrate.

There are myriad methods of applying coatings to surfaces or substrates ranging from dipping of the substrate in the coating and the use of brushes and rollers to air spraying and electrostatic spraying of the substrates. When the coating has a viscosity range of from about 100 to about 2,000 centipoise, and when this coating is to be applied to substrates such as walls, paperboard, plywood and pressed fiber boards, gypsum boards, metal sheet or strip or foils, cement blocks, stucco, masonry, concrete irregular flat items and irregularly shaped items, the coatings have traditionally been applied by the use of brushes, rollers or pads. These coatings with the viscosity in this viscosity range can be aqueous latexes, emulsions and dispersions, organic-solvent lacquer solutions and dispersions, plastisol and organosol formulations, oleoresinous compositions, plastic monomers and reacting formulations such as epoxies and polyesters. The particular coatings applied to particular substrates by brushes, rollers and pads include such applications as: architectural coatings and exterior oil and latex paints applied to cement blocks, stucco and masonry and architectural coatings and interior oil and latex paints applied to plaster, paperboard, gypsum and plywood walls, and floor paints and other paints for wood and concrete and asphaltic materials for roads and driveways. For these applications, the brushes are traditionally made with nylon or polyester fibers. The rollers are traditionally made with absorbent cloth-like material, polyester fibers, fibers of thermoplastic polymeric materials, or lambskin. The pads are traditionally made of mohair, nylon filaments or natural or synthetic bristles adhesively attached to a foam pad such as a polyester spongy material.

When pads and rollers are used to apply coatings having a viscosity in the range of about 100 to about 2,000 centipoise in a wet coating thickness on the average of 0.002 to around 0.008 inches, the coating that is applied usually has peaks and valleys on a microscopic level within a given distance of the surface of the coating. Various flow leveling or rheology modifying additives can be added to the coating compositions to reduce the peak to valley ratio in order to effect a smoother finish for the coating. The ideal peak to valley ratio would be one approaching a one to one ratio, whereas in current commercial practice, the obtainable peak to valley ratio is around 3 to 1. This ratio is obtainable in commercial practice with fresh rollers or pads being used to apply the coating. After the initial use of the current rollers or pads, the wet fibers in the rollers or pads tent to clump together and twist to produce an effect referred to as rat tailing. The rat tailing effect produces additional irregularities in the finish of the coating, thereby reducing the achievement of a smooth finish for the coating applied to a surface or substrate. The irregulartiy results mainly from the rat tailed fibers causing splattering by expelling filaments of coating material during the application. Hence, the rat tailed filaments in the applicator actually exacerbate the problem of a high peak to valley ratio and increases the production of rippled appearance of the finished coating composition.

Other factors that are important in the efficient application of a coating composition to achieve a uniform finish on a substrate are the amount of coating composition picked up by the applicator, the amount of coating composition released by the applicator and the amount of coating composition held by the applicator. These factors can effect the resultant finish of the coating composition on the substrate. For example, the depth of the pile on the surface of an applicator is important in the roller's ability to hold a given quantity of coating composition and in the roller's ability to yield a smooth finish. It is known that rollers having surfaces with short naps result in smoother finishes of the coating composition on a substrate than finishes obtained with applicators having longer naps.

It would be an advance in the art to have an applicator, which assists in reducing the peak to valley ratio of the surface of a coating on a substrate to a value of less than around 3 to 1 to produce a smoother finish and appearance of the coating composition on the substrate. It would also be beneficial to have applicators for coating compositions that have improved characteristics of coating pickup, release and storage.

It is an object of the present invention to provide applicators for coating compositions having viscosities in the range of about 50 to about 2,500 centipoise or greater that produce a finish or appearance of the coating on substrates which is smoother and of improved uniformity, while also achieving additional benefits of improved pickup, release and storage of the coating in and by the applicator.

SUMMARY OF THE INVENTION

Accordingly, this object and other objects gleaned eclectically from the following disclosure are achieved by the present invention that utilizes a mat in an applicator, where the mat is constructed of one or more sized glass fibers and/or strands and where fibers and/or strands project from the surface of the mat. The mat is one or more layers of needled glass fiber and/or strand mat, or a multiple layered mat, where one layer is comprised of sized glass fiber and/or strand contacting a second layer so that fibers and/or strands project through the second layer.

The present invention is an applicator for applying coating compositions to substrates having a core with two surfaces and which has intimately bound to one of its surfaces a mat of one or more layers of needled, sized glass fibers and/or strand mat where the fibers and/or strands distributed or deformed during needling project from the surface of the mat. In the multilayered mat with projecting glass fibers and/or strands, the first layer of mat in contact with the core is a mat of sized glass fibers, strand or strands. The second layer of mat is any mat or web of fibrous material that allows fibers, bundles of fibers, strand and strands, hereinafter referred to as glass fibers, of the sized glass fiber mat to project or protrude through the second mat. Such protrusion is where the majority of protruding glass fibers have multidirectional orientation through and/or beyond the surface of the mat.

The second layer of mat can be made of any natural or artificial fiber that is capable of being produced into a mat or web form of sufficient density that allows for integrity of the web, but that also allows for protrusion of the glass fibers, through the web. The contact of the second layer of mat to the layer of sized glass fiber mat can be any type of contact that does not drastically reduce the protrusion of the glass fibers from the layer of glass fiber mat through the second layer of multilayered mat. The contact should increase the protrusion of the glass fibers from the layer of glass fiber mat through the second layer in a similar manner as the contact that is produced by needling. When the contact is provided by needling, the glass fiber strand mat in the first layer of the multilayered mat may be needled and the second layer of the multilayered mat is placed in contact with it by any method known to those skilled in the art. Also the glass fiber mat of the first layer and the second layer of mat can be needled together.

In producing the mat of the present invention, the thickness of and the filament diameters of the fibers in the one or more layers of needled glass fiber mat can vary depending on the type of coating application to be applied to the substrate and the efficiency desired in applying the coating. In producing the multilayered mat, with the glass fibers of the glass fiber mat layer protruding through the second layer, the thickness of and filament diameters of the fibers in both layers of the multilayered mat can be varied to a degree. The thickness of the second layer is generally in the range of about 0.03 inch to about 2 inches (about 0.8 to about 50 mm.). Also, the thickness of the glass fiber mat can vary commensurate with the desired quantity and quality of pick up and release and storage of the coating composition by the multilayered mat. Generally, the thickness of the glass fiber mat should range from about 0.03 inch to about 2 inches (about 0.8 to about 50 mm.). Another factor affecting the protrusion of the glass fibers through the second layer is the filament diameter of the glass fibers, which can vary from submicron to multiple micron values of around 30 microns. The filament diameter of the fibers comprising the second layer of the fabric is also a factor relating to the protrusion of the glass fibers through the second layer. Generally, the filament diameter of the fibers in the second layer ranges from submicron range to the multiple micron range of about 30 micrions. The filament diameter of the second layer of fabric will vary with the thickness of the second layer of fabric so that a proper density for the second layer of the fabric can be achieved to enable the glass fibers of the glass fiber mat layer to protrude through the second layer of fabric.

The glass fibers are sized so that they have a substantial portion of their surface covered with the dried residue of a chemical treating composition having at least a film forming polymer, compatible coupling agent and a carrier. The dried residue protects the glass fibers from abrasion during application of coatings and during any cleaning treatment for removing excess coating composition from the applicator.

The core can be constricted of any material capable of withstanding the stresses of holding a surface of fiberous mat or web, which becomes ladened with a coating composition for application to a substrate and the forces of moving the core with the surface of mat to dislodge the coating from the surface onto the substrate.

The one or more fibers and/or strands constituting the needled glass fiber mat or the first or second layer of the multilayered mat are held together by entanglements of the fibers and/or strands, and/or by chemical treatment. The entanglements and/or amount of chemical treatment in and on the various mats must not be too great as to preclude capillary movement of the coating composition along the fibers and strands and into the interstices between the fibers and strands. The entanglements of the fibers and/or strands arise from the pattern at which the various fibers and/or strands are laid to form the various mat and from disturbances by any process subsequent to mat formation. The chemical treatment is a resinous binder placed on the various mats during or after their formation.

BRIEF DESCRIPTION OF THE DRAWINGS

FIG. 1 is a plane view of the multilayered mat of the present invention having two layers, where one layer is comprised of continuous sized glass fiber strands.

FIG. 2 is a plane view of a roller applicator of the present invention showing the multilayered mat having two layers on a cylindrical core.

FIG. 3 is an enlarged detailed view of a portion of the traverse section through the applicator roll of FIG. 2 illustrating the contact of the two layers of the multilayered mat to enable protrusion of the glass fibers through the second layer of fabric.

FIG. 3A is an enlarged detailed view of a portion to the traverse section through a cylindrical applicator roll, where the mat is one layer of needled glass fiber strand mat having fibers, strands or parts of fibers and strands projecting from the surface of the needled mat.

FIG. 4 is an off-centered view of the roller of FIG. 2 which is attached to a handle.

FIG. 5 is a side view of the fabric of FIG. 1 attached to a handle in a pad applicator construction.

FIG. 6 is a plane view of a painter's glove having the multilayered mat of the present invention.

FIG. 7 is a photograph of the surface finish of paint applied to a card by a commercially available paint roller having polyester fibers.

FIG. 8 is a photograph of the surface finish of paint applied to a card by a roller applicator of the present invention.

DETAILED DESCRIPTION OF THE INVENTION

The present invention is based on the discovery that the use of particular mat arrangements of glass fibers in an applicator for applying coating compositions to substrates results in more efficient application of smoother finishes of the coatings on substrates. Parameters that are factors in applying coating compositions to substrates include the following: coating pickup by the applicator per one given loading; the discharge rate, which is the rate at which the coating is distributed in terms of weight per square foot or mil thickness per square foot; the uniformity of application, which is the smoothness of the finish of the coating on the substrate; chemical and solvent resistance of the applicator to the coatings; the resistance of the applicator to dimensional change when wet; and the fiber continuity of the applicator when wet.

The use of glass fibers in the coating applicator of the present invention gives benefits in most of these categories of coating parameters. For pickup of the coating, the amount of coating that is picked up by the applicator of the present invention is an increased amount over conventional applicators because, it is believed without limiting the invention, that the fiber glass mat layer acts as a reservoir for the coating. The discharge rate of the coating from the applicator of the present invention can also be improved, since more of the coating is released by the applicator for a single application of the coating to a substrate. The applicator of the present invention results in a more uniform application of the coating to give a smoother finish of the coating on a substrate, where the smoothness is evident from a reduced peak to valley ratio of the coating surface. Because of its chemical nature, the applicator of the present invention utilizing glass fibers is more resistant to those chemicals and solvents used in coating compositions. The applicator of the present invention with the glass fiber layer has good resistance to dimensional change when wet, since glass fibers are less prone to dimensional change, when subjected to water and other solvents for long periods of time. The glass fibers do not swell, when in contact with these materials, and the glass fibers maintain a high degree of rigidity. The applicator of the present invention maintains good fiber continuity upon repeated use, whereas most fibers, when wet from a coating media, tend to lump together producing an effect called rat tailing. The good fiber continuity of the present applicator results from the glass fibers because of adjustable surface tension via chemical treating compositions or sizings and rigidity of the fiber itself, which leads to little if any production of the rat tailing effect. This results in a nearly constant peak to valley ratio upon subsequent use of the applicator; thereby, the surface smoothness of the coating on the substrate from initial to subsequent usage is assured.

FIG. 1 shows the multilayered mat, 10, used in the applicator of the present invention. Mat 10 is comprised of two layers, a glass fiber layer 12 and a second layer 14. The glass fiber layer is comprised of continuous or staple glass fibers, bundles of fibers, strands and/or strands (hereinafter collectively referred to as fibers) where the glass fibers have a residue of a chemical treating composition.

The glass fibers can be produced by standard processes, for example, by steam or air blowing, flame blowing and mechanical attenuation. The glass fibers can be manufactured from any known glass batch composition such as "E" glass or "621" glass or more environmentally acceptable derivatives thereof. Where electrical properties of the glass fibers are not paramount, the low soda glass known as "C" glass and the glass known as "A" glass can also be used. Also, the high strength glass compositions such as "HS" glass and "S" glass can also be used. The filament diameter of the glass fibers can range from submicron level to many microns and particularly, about 1 to 30 microns. The glass fibers can be in any continuous or staple form, such as continuous solid glass fibers, continuous texturized, bulked crimped, hollow, and/or etched hollow or etched solid glass fibers and mixtures thereof as individual fibers, bundles of fibers, or one or more strands. The staple glass fibers can be held in a strand form by mechanical or chemical means. The hollow glass fibers can be produced by the processes and the apparatus of U.S. Pat. Nos. 3,268,313; 3,421,873 and 3,510,393 hereby incorporated by reference. The etched hollow or solid fibers can be produced in accordance with the teachings of U.S. Pat. No. 4,046,948.

In the preparation of glass fibers, a chemical treatment is applied to the glass fibers shortly after their formation to protect the fibers from intrafilament abrasion and to achieve a desired surface tension between the fibers and the coating composition to be applied to the surface or substrate. For example, in the mechanical attenuation process of forming glass fibers, the glass fibers are drawn from numerous orifices in a bushing, which is a heated platinum-containing device fitted into the furnace that melts glass batch material or glass. The drawing force for attenuating the fibers from the bushing is provided by a winder, which collects the glass fibers as continuous fibers for one or more continuous strands into what is referred to in the art as a forming package. As the numerous glass fibers are attenuated from the bushing and after they have cooled sufficiently, the chemical treatment is applied to them.

The chemical treatment is a solution, emulsion, dispersion or mixture having at least a carrier, a film forming polymer and a compatible coupling agent. The chemical treatment can also contain other ingredients such as a lubricant and modifying agents. The carrier can be an organic solvent or water in amounts to maintain the chemical treating composition in its soluble or dispersed form.

The film forming polymers used in the chemical treating composition are those that form a film on a substrate upon evaporation of the carrier. Nonexclusive examples include starch materials and thermoplastic and thermosetting polymer materials such as polyvinyl acetate, polyesters, epoxies including 1,2-epoxies, polyurethanes, ethylene vinylacetate copolymers, acrylic vinylacetate copolymers, acrylic polymers, homopolymers and other copolymers, water insoluble starches, gums, such as gum arabic, gum tragacanth and gum karay; glues, cellulosic materials such as carboxymethyl cellulose, hydroxyethyl cellulose, methyl cellulose; oxyethylated stearates, ureaformaldehyde polymers, melamineformaldehyde polymers, acetoneformaldehyde polymers, phenol-formaldehyde polymers; alkyl resins such as glycerylphthalic anhydride reaction products; polyamides, saturated and unsaturated polyesters, hydrocarbon-siloxane resins, vinyl resins such as homopolymers and copolymers of ethylene, propylene, styrene, isobutylene, butadiene, acrylonitrile, vinyl chloride, vinyl pyrrolidone, vinylidene chloride, vinyl acetate, vinyl alcohol acrylic acid and ester thereof, methacrylic acid and esters thereof, and the like. Mixtures of these film-formers may also be employed. These film-formers are preferably used in the form of aqueous solutions or emulsions.

The particular film formers are polyvinyl acetate, polyvinyl pyrrolidone, polyacrylate and polymethacrylate esters, polyacrylamide, polymethacrylamide, saturated polyesters, unsaturated polyesters, epoxy resins, melamine resins, phenolic resins and copolymers and mixtures of these materials.

The film forming material in the sizing composition can be modified as can the other ingredients to achieve a desired surface tension for the glass fibers in the glass fiber strand to maximize or minimize pick up and release of the coating composition to be applied to a surface or substrate from the applicator of the present invention. The film forming polymer forms a film on the glass fibers, where a coupling agent is already present on the fiber, or where the coupling agent has been reacted with the film forming polymer.

The coupling agents used in the chemical treating composition can be silane coupling agents, titanate coupling agents and Werner complex coupling agents having various reactable groups on the molecule to react with the film forming polymer through acid base reaction to form salt products or organic reactions like addition polymerization through unsaturated functional groups. Particularly useful coupling agents include: amino-functional silane coupling agents, like gammaaminopropyltriethoxysilane, epoxy-functional silane coupling agents like gamma-glycidoxypropyltrimethoxysilane and silane coupling agents where the reactive organo moiety is a free radically polymerizable moiety such as acrylate, methacrylate, alkyl, vinyl like gamma-methacryloxypropyltriethoxysilane.

The reactability of the coupling agent, which associates with the glass surface, and the film forming polymer is necessary to maintain the residue present on the glass fiber to protect them from abrasion during use. This use includes applying coating compositions to substrates and cleaning of the applicators for repeated usage. Some care in cleaning the applicators of the present invention is necessary so as not to cause unnecessary abrasion of the glass fibers.

Other examples of reactable systems of film forming polymers, coupling agents and some lubricants such as those described in U.S. Pat. Nos. 2,946,701, 3,081,195 and 3,350,345 can be used. All of these patents are hereby incorporated by reference.

The chemical treating composition commonly referred to as a sizing composition can be modified by varying the amounts and types of film forming agents and/or coupling agents and additional agents such as surfactants, anti-static agents and the like, to achieve a desired surface tension for the treated glass fiber. By varying the surface tension of the treated glass fiber, the applicator of the present invention can have a varied rate of pickup and release of the coating composition to be applied to a substrate.

The chemical treatment can be applied to the glass fibers by any method known to those skilled in the art such as roller applicators, spray applicators and the like, after the glass fibers are formed, but before they are gathered into one or ore strands and collected into forming packages by the winder. The forming of glass fiber strands can occur at such high speeds of around 4,000 to 7,500 rpms to produce strand travel speeds of around 12,000 to 15,000 feet per minute. Details of applicators used to apply chemical treating compositions to glass fibers are shown in U.S. Pat. No. 2,728,972, hereby incorporated by reference. A representative method of fiber formation and application of chemical treatments to glass fibers is the process illustrated in FIG. 2 of U.S. Pat. No. 3,849,148 which is hereby incorporated by reference.

The forming packages of glass fibers can be used directly or gathered into roving, which is a rope structure of many glass fiber strands for forming a glass fiber mat. In FIG. 1 the continuous glass fiber strands are indicated by numeral 16 in the glass fiber strand mat layer 12. The glass fiber strand mat 12 is prepared from one or more continuous glass fibers and/or strands. When the glass fiber mat is used with the second layer in a multilayered mat, the mat can be produced by any method known to those skilled in the art. A nonexclusive example of mat formation is drawing the glass fibers and/or strands from one or more sources of glass fibers such as forming packages into a feeder, which reciprocatingly traverses a moving horizontal belt or rotating drum. The feeder lays down the glass fiber strands as it reciprocates back and forth across the moving horizontal belt or rotating drum. The mass of glass fiber strands on the belt can then be dried if the moisture content of the glass fiber strands being fed is more than desirable. The continuous glass fiber strand mat is then collected at the end of the horizontal belt or drum.

Also the mat can be formed from a swirling motion of the feeder to give a swirl mat or the mat once formed can be passed through a needler to produce a needled mat. Examples of processes of producing continuous glass fiber strand mat are those taught in the following U.S. Pat. Nos.: 3,154,836; 3,219,012; 3,265,481; 3,265,482; 3,469,796; and 3,511,625, all of which are hereby incorporated by reference. Needled continuous glass fiber strand mat may be produced according to those skilled in the art such as those of the following U.S. Pat. Nos.: 3,664,909; 3,883,333; 3,915,681; and 4,158,557, all of which are hereby incorporated by reference. When the glass fiber mat is to be used without the second layer in the multilayered mat, the glass fiber mat must be produced by needling. One or more needled glass fiber mats may be used to construct the mat for the applicator.

The source of the continuous glass fiber strand can be as mentioned, the forming packages of glass fiber stands or roving packages of a plurality of continuous glass fiber strands, but the source can also be glass fiber strands being formed directly from a bushing of a glass melting furnace. It is also within the scope fo the present invention to have the glass fibers reciprocatingly traversed from a feeder onto a rotating drum which collects the fibers into a mat. When the glass fibers are provided directly from forming, the mat can be formed by a pair of rollers being used instead of a winder in the glass fiber forming process. The rollers grip the strand and project it downward, where the strand impinges on a deflector located above a moving belt which receives the deflected strand. Also, the glass fiber strand mat can be formed from the bushing, where a pull roll and drawing rollers are substituted for the winder in the forming process. The strands are attenuated by the drawing rollers and pass over the pull wheel. The pull wheel has longitudinal slots which coincide with veins on a smaller wheel which rotates inside the pull wheel. The smaller wheel acts as the ejecting wheel and the strands are ejected from the pull wheel with the assistance of air being blown from the inside of the pull wheel. The mat that is produced consists of several interlocking layers of loops of strands.

In contact with the glass fiber mat 12 is a second layer mat depicted in FIG. 1 by numeral 14 to make up the multilayered mat 10. This mat can be formed from any natural or synthetic fiber that can form a continuous fiber or strand mat. Nonexclusive examples of such fibers include nylon, acrylic and modacrylic, linen, cotton, poly(ethylene terephthalate), acetate viscose, wool, polyesters, cotton and glass fibers. This nonwoven mat or web is comprised of continuous and/or staple-length filaments or strands laid down mechanically in a random manner or with some orientation. The web or mat has integrity for handling from interlocking filaments and/or strands or by being bonded together with an adhesive for binder. Nonexclusive examples of suitable binders include polyvinyl acetate, elastomeric latices, and dispersions of vinyl polymers, amino resins, and water soluble cellulose derivatives. The types of fibers also include vinyl chloride acetate fibers and vinylidene chloride continuous filaments. The preferred fibers for the second layer mat are the acrylic fibers, although modacrylic fibers can also be used. The acrylic fibers are ones in which the fiber forming substance is a long chain polymer composed of at least 85 percent by weight acrylonitrile units while the modacrylic fiber is one in which the fiber forming substance is less than 85 percent but usually at least 35 weight percent of acrylonitrile units. The other constituents in the acrylic fiber that are copolymerized with the acrylonitrile in various quantities include vinyl monomers such as vinyl acetate, vinyl chloride, styrene, vinyl pyridine, acrylic esters or acrylamide. In the modacrylic fibers the material that is copolymerized with the acrylonitrile is either vinyl chloride of vinylidene chloride. These fibers and mats can be made by any process known to those skilled in the art. The fiber diameters for the fibers making up the fibrous mat or the fibrous plurality of which comprise the strands making up strand mat can range generally from submicron to 30 microns. The density of the second layered mat is sufficient to allow protrusion of the glass fiber or glass fiber strands from the first layer through the second layer. Generally, to allow this protrusion, the thickness of the second layer mat is in the range of about 0.03 inch to about 2 inches (0.8 to 50 mm).

In all of these methods of producing the various mats of fibers and/or strands, when the fibers or strands are deposited on the belt or drum they usually become entangled to a degree. These entanglements result from the deflection of the fibers and/or strands off of a deflector, which is closed to the feeder or from the fibers and strands hitting the belt or drum. The entanglements provide mechanical integrity to the various mats. In lieu of or in addition to entanglements, the mat may also have chemical integrity. For the mats of glass fibers, this integrity can be provided by two approaches. One approach is to have extra chemical treatment present from the formation of the glass fibers. When a mat of these fibers or strands is heated or dried, any thermoplastic resinous or polymeric material in the residue on the glass fibers will flow and subsequently harden when the heating or drying is terminated. This repositioned thermoplastic material may bridge various fibers or strands in the mat to provide some integrity. Another approach to provide integrity for the mats of glass fibers or the second layer mat of the multilayered mat is by chemically treating the mat during or after its formation. Such a chemical treatment would have a resinous or polymeric binder which is applied to the mat to hold the fibers and/or strands together in the mat configuration.

The dimensions of the mat as needled glass fiber mat or as multilayered mat for use in the applicator can vary depending on the type of applicator, but the thickness or nap of the mat indicated by numeral 11 in FIG. 1 should be in the range of about 0.125 inch to about 2 inches (about 3 to about 50 mm.). The thicker needled glass fiber mats and the multilayered mat may produce favorable formation of a reservoir of the coating composition, when the mat is contacted with the coating composition to be applied to a substrate. Such a reservoir assists in the efficient transfer of the coating composition from the applicator to the substrate. Also, the needled glass fiber mat or the glass fiber mat used as the first layer of the multilayered mat or the second layer of multilayered mat has one or more fibers and/or strand and/or strands held together by fiber and/or strand entanglements and/or by chemical means to allow for adequate pick up and discharge of the coating by the applicator. The entanglements or amount of chemical treatment is not so great as to give a packing characteristic of the fibers and/or strands in the mat that would preclude capillary action of the coating in the various mats. The pick up and release of the coating composition to be applied to a substrate can occur by forcing the coating composition into the mat by dipping the mat into the coating, or by spraying the coating onto the mat. Also, capillary action of the coating along the fibers and strands and through the interstices of the various mats assists in the pick up of the coating compositions by the mats. The discharge of the coating from the mats is effected by movement of the mats with applied pressure over the substrate. Therefore, the fibers and strands in the mats must be held together adequately by the fiber and/or strand entanglements, interlocking layers, or chemical treatment to permit the mat to maintain its integrity during these operations.

The thickness of the mat with fiber and/or strand projections varies between about 0.03 inch and 2 inches. This mat includes the needled glass fiber mat and the multilayered mat. The thickness varies depending on the type and viscosity of the coating to be applied to a substrate by the applicator with the present invention. For example, the enamels with a thinner viscosity can be applied with an applicator having a shorter nap. The flat paints have a higher viscosity require applicators with thicker naps.

In the multilayered mat, the relative thickness of the two layers can also vary between about 5 and about 95 percent of the thickness of the multilayered mat. If better storage of the coating by the mat is desired, the thickness of the first glass fiber layer should be increased. Preferably, the relative thickness of the two layers is about 75/25 to about 50/50 percent of the first layer of glass fiber mat to the second layer mat based on the total thickness of the multiple layered mat.

The multilayered mat of the present invention is shown in FIG. 2 as an applicator on a cylindrical core in the form of a roller applicator. FIG. 3 which is a portion of a transverse section of the roller applicator shows the protrusion of the glass fibers and/or glass fiber strands through the second layer mat. In FIG. 3 the glass fiber strand mat 16 is in intimate contact with core 20 either through mechanical attachment or adhesive attachment. Contacting glass fiber strand mat 16 is second layer 14. Although FIG. 3 shows the transverse section of the roller applicator, the protrusion of the glass fiber and/or strands through the second layered mat for the multilayered mat as in FIG. 1 is similar. This contact to allow protrusion of the underlying glass fiber strand mat through the second layered mat is effected by such techniques as tufting, pile weaving, sliver knitting, terry knitting, stitch-bonding, and needle punching or needling in a conventional needle loom with barbed needles. It is also possible that the second layer of the mat may be placed and stretched over a needled glass fiber strand mat. It is preferred that the second layer mat is connected with the glass fiber strand mat by needling. The method of producing the needled multilayered mat of the glass fiber strand mat and the second layered mat is accomplished by combined needling as a result of the two layers of mats being needled together in a needle loom. The needle loom has a needler which reciprocates vertically over the two mats and a plurality of needles are pushed through the mats and then pulled out to intertwine the glass fiber strands and cause them to protrude through the second layered mat. Then the needled fabric is collected for cutting into the proper dimensions for use in the applicator of the present invention. In FIG. 3 the fibers and strands that protrude through the second layer 14 are depicted as fibers and strands 22.

In FIG. 2, there is shown the applicator of the present invention having a roller construction. The fabric comprised of glass fiber strand layer 12 is attached to core 20. Contacting the glass fiber strand layer 12 is the second layered mat 14. The fabric comprised of glass fiber strand mat 12 and second layered mat 14 can be attached to core 20 by any means known to those skilled in the art such as mechanical attachment or chemical attachment by means of adhesive bonding. Core 20 with the multilayered mat makes up roller 24 which is engageable with a handle as shown in FIG. 4 as handle 26. The core 20 can be of any materials known to those skilled in the art for forming cores of a roller or pad applicator and nonexclusive examples include paper cores and polymeric impregnated materials such as polypropylene, polyethylene, polyvinyl chloride, and polymethylmethacrylate and the like. The dimensions of the rollers are those of common rollers such as seven inches long or nine or thirteen inches long with about 1½ to two inches in diameter and a wall thickness of around 0.05 inches. The thickness of the mat on the core can be varied somewhat so that shorter nap mats produce even smoother finishes. When the mat is adhesively bonded to the core 20, any adhesive known to those skilled in the art such as epoxy adhesives can be used.

In making the roller applicator of the present invention, any method of applying the needled glass fiber mat or multi-layered mat to the core with the use of mechanical, chemical or adhesive means can be used. For example, the needled mat or multi-layered mat can be cut to a size identical with the core and the adhesive applied to the first layer of glass fiber strand mat and this surface is then contacted with the core for a sufficient period of time at sufficient temperature and pressures to allow for an adequate bond. Also, the multi-layered fabric for a roller can be made by any method to eliminate a noticable seam on the cover of a roller applicator. An example is to place the multi-layered mat on the core by spiral winding of the mat onto the core where the width of the strip of fabric is less than the desired length of the roller. Here again, an adhesive can be applied to the first layer of glass fiber strand mat which is then contacted with the core in this spiral winding.

FIG. 3A depicts the enlarged view of a portion of a transverse section of a roller applicator, where the mat is needled glass fiber mat. In this figure, mat 10 as needled glass fiber mat engages core 20 by adhesive layer 34. The strands and fibers projecting in all directions from the surface of mat 10 (a multidirectional orientation) are shown as 36 and 38 respectively. The needled mat is produced by any method known to those skilled in the art such as the aforedescribed processes. If the integrity of the needled mat is not sufficient from needling alone, then added integrity through chemical means can be employed.

FIG. 4 depicts the roller of FIG. 2 engaged with handle 26 to form a roller applicator. Here a slightly off-centered view shows the multi-layered 10 on core 20, where the mat consists of the two layers, the underlayer of continuous glass fiber strands, 12 and the overlayer of second layer mat 14. Preferably, the roller is removable from handle 26 to facilitate proper cleaning of the roller.

FIG. 5 shows the applicator of the present invention attached to a handle in a pad applicator construction. The multiple layer mat 10 is shown comprising the glass fiber strand mat layer 12 and the secondary mat layer 14. Also protrusions 22 from the glass fiber strand mat 12 are shown passing through and at the surface of secondary mat 14. A core 20 is attached to the glass fiber strand mat 12. The core in this instance can be paper, impregnated paper, metallic or polymeric material and the glass fiber strand mat can be attached directly to the core material by mechanical or chemical or adhesive means. Also, it is possible that the paper-type core may be present in between the glass fiber strand mat 12 and core 20, where the mat is attached to the paper-type core and the paper-type core is then attached to the polymeric core. The applicator of this embodiment includes handle 28 which is attached to core 20, when core 20 is a polymeric or metallic or to backing member 30. Generally speaking, the applicator pad has substantially parallel front and rear edges **28*a* and 28*b* and can have parallel or nonparallel side edges. In the pad form, the applicator can be of any dimension typically used in applicator pads such as the rectangular form or a form having substantially parallel front and rear edges and nonparallel side edges which may converge toward each other in a forwardly or rearwardly direction. Also, the sides may converge upwardly and inwardly toward each other in a vertical fashion or be parallel. The applicator includes a generally rigid backing member 30 having laterally extending front and rear flanges 32*a* and 32*b* along the front and rear edges thereof for attachment of handle 28. Although any other attachment means other than 30*a* and 30*b* may be used, such as those attachment means known to those skilled in the art for attaching a pad assembly to a handle for a paint pad applicator. In addition, a compressible intermediate member preferably of a sponge-like substance or foam substance, such as polyester foam, can be adhered to the backing member 30 as a separate sponge member or as shown in FIG. 5 as the substitute when the core 20 is the sponge-like member for core 20. The continuous glass fiber strand mat 12** is bonded directly to the sponge-like member.

FIG. 6 depicts the applicator of the present invention as a painter's glove or mitt. Here, mitt 40 is the core to which mat 10 is attached. Mat 10 is comprised of layer 12 of glass fiber mat and second layer 14 through which glass fibers and/or strands project. The mat 10 could also be a needled glass fiber mat as could be the mat 10 of FIG. 5. The mat can occupy the palm portion of the mitt as indicated in FIG. 6, or it can occupy the entire front and reverse side of the mitt. The mitt can have fingers or merely a thumb and one common area for the fingers. The mat 10 is attached to glove core 40 by any mechanical or chemical means known to those skilled in the art. As shown in FIG. 5, the attachment can be by adhesive layer 34 or by stitching. When the entire mitt is covered with the mat 10, the mitt can actually be constructed of the mat and have a built-in liner to cover the hand.

A typical example of such a process is to have a cylindrical core with an inner and outer surface and a length longer than the length of the final roller. The mat is prepared into a strip which is narrwer than the final length of the roller, a preferred length is around 3 inches (7.6 cm.). Adhesive is applied to one side of the strip and the strip is helically wound onto the cylindrical core so that the strip lays in edge to edge relationship on the cylindrical core. The core with the covering of mat is cut to the desired length for a roller.

PREFERRED EMBODIMENT

In the preferred embodiment of the present invention, the applicator can be of a pad or roller construction where the multi-layered mat is preferably a glass fiber stand mat as a first layer and an acrylic mat as a second layer which has been needled together in a needle loom. The chemical treatment which is present on the glass fibers making up the glass fiber strand in the mat preferably has a polyvinyl acetate film former, fatty acid type lubricant and an organo reactable silane coupling agent. Also, the strands making up the mat are preferably of varied dimensions such as strands comprised of fibers with one size of filament diameter and strands comprised of fibers with another size of filament diameter, where the filament diameter most preferable is in the range from about 5 microns to 20 microns. One of the strands for the varied construction for example, can be those of G-150 which means a fiber strand with an average filament diameter of between 8.9 and 10.16 microns and 15,000 yards per pound of strand which implies the strands consist of 200 filaments. The other strand in the mat may be K-75 strand which means the fiber in the strand has an average filament diameter between 12.7 and 14.3 microns while the 7,500 yards per pound would imply twice as many fibers per strand as the G-150 or 400 fibers per strand. It is also possible that the strand could be a mixture of fibers having varying fiber diameters. It is also possible that the mat can be comprised of strand having various constructions, while also having residues of various sizing compositions. Preferably, the first layer of glass fiber mat has a thickness of about 0.03 inches of about 2 inches (about 0.8 to about 50 mm.).

The second layer mat is preferably any acrylic fiber mat having good integrity for handling and undergoing the rigors of needling. The thickness of the acrylic mat is in the range of about 0.03 inches to about 2 inches (0.8 to 50 mm.). This mat is needled with the glass fiber strand mat in a conventional needle loom to form the multilayered mat. The multilayered mat is applied to a paper polymeric core for a roller and sponge-like material for a pad by applying an epoxy resin adhesive to the base layer of glass fiber strand mat which is then contacted to the core.

The preferred embodiment is further elucidated by the following example.

EXAMPLE 1

A paint roller was made using needled multilayered mat where the first layer was a glass fiber continuous strand mat, where the fibers in the strand had a filament diameter of about $2.8\times10^{-4}$ inches ($7.2\times10^{-4}$ mm.). The second layer was of acrylic fibers where the fibers had a filament diameter of about $3.7\times10^{-4}$ inches ($9.42\times10^{-4}$ mm.). The two mats were needled together in a conventional needle loom according to a needling process as shown in U.S. Pat. No. 3,883,333. The needled fabric was adhered to a cardboard core having dimensions longer than 9 inches in length and about 1½ inches in diameter. The roller was made in a manner to eliminate any noticable seam. This is accomplished by helically winding the strip of mat around and adhesively secured to the core. With this end-to-end helical arrangement any edge of the strip, except for the edges at the ends of the roller are immediately adjacent to another edge of the strip along the longitudinal cylindrical surface of the roller. The covered roller had both ends cut to have a longitudinal length of 9 inches.

The coating applicator of the present invention can be used to apply any coatings, aqueous based or oil based like those previously mentioned, having a viscosity in the range of about 50 to about 2,500 centipoise to any substrate like those previously enumerated. The usual wet coating thickness laid down by the applicator is in the range of about 0.001 to about 0.01 inch.

The thickness of the needled fabric was in the range of about 40 percent acrylic mat and 60 percent continuous glass fiber strand mat.

The roller applicator of the present invention was used to apply white paint to a substrate. The surface achieved from the applicator was compared with a surface achieved from an application of a commerically available polyester roller applicator available from PPG Industries, Inc., under the trade designation Gold Stripe, Product No. PDN which had a ⅜ inch nap. The same white paint was used for both rollers and the manner of application was the same for both rollers. The paint was applied by both rollers to a 4.86 square foot section of the same substrate. The results of the application are shown in FIGS. 7 and 8. FIG. 7 is a photograph of the coated substrate with the commercially available roller applicator. FIG. 8 is a photograph of the painted substrate produced with the roller applicator of the preferred embodiment. The finished application as shown in FIG. 8 is a more uniform application with a smoother finish. In the roller of the present invention, the grams of paint used to cover the same size substrate as that used with the commercial roller and the coverage of paint on the substrate was only 233.6 square feet per gallon.

The foregoing has disclosed an applicator for applying coatings to substrates to achieve a more uniform and smoother finish. The applicator has a multilayered fabric comprised of a base layer of glass fiber strand mat and a second layer of mat with a density to allow protrusion of glass fibers and/or strands from the base mat through the second mat when the second mat contacts the base mat. This multilayered fabric is attached to a core and the core is then engaged with a handle for a roller applicator or a pad applicator or the like.

We claim:

1. A coating applicator for applying coatings to substrates, comprising:

a. a core having two surfaces and adapted for being held, b. a mat of sized glass fibers having fibers protruding from the surface of the mat where the protruding fibers have multidirectional orientation and where the mat is engaged to one of the surfaces of the core.

2. Applicator of claim 1, where the mat is needled glass fiber mat.

3. Coating applicator of claim 2, wherein the needled mat has an arrangement of fibrous material provided by sufficient entanglements between the fibrous material to allow for pickup and discharge of the coating from the coating applicator but not too many entanglements to give a packing factor to preclude capillary action of the coating in the mat.

4. Coating applicator of claim 2, wherein the needled mat has an arrangement of the fibrous material provided by sufficient chemical integrity to allow for pickup and discharge of the coating from the applicator but not too much chemical integrity to give a packing factor to preclude the capillary action of the coating in the mat.

5. Coating applicator of claim 2, wherein the needled mat has an arrangement of the fibrous material provided by sufficient entanglements and chemical integrity to allow for pickup and discharge of the coating from the applicator but not too many entanglements nor too much chemical integrity to give a packing factor to preclude capillary action of the coating in the mat.

6. Applicator for claim 1, where the mat is a multilayered mat having a first layer, which is a mat of sized glass fibers engaged to one surface of the core and having a second layer, which is mat of fibrous material, where the fibrous material in the second layer has an arrangement and where the second layer contacts the first layer in such a manner so that the arrangement and contacting allows the glass fibers of the first layer to protrude through the second layer.

7. Coating applicator of claim 6, wherein the first layer is needled glass fiber mat.

8. Applicator of claim 6, wherein the first layer has a thickness in the range of about 0.03 inches to about 2 inches.

9. Coating applicator of claim 6, wherein the second layer is comprised of fibers selected from the group consisting of acrylic, polyethylene, nylon, cotton, wool, linen, glass fiber, viscose, and mixtures thereof.

10. Coating applicator of claims 1 or 6, wherein the mat of glass fibers is comprised of strands having fibers of varying filament diameters.

11. Coating applicator of claim 1 or 6, wherein the glass fiber mat is comprised of strands having various strand construction.

12. Coating applicator of claim 6, wherein the first layer of glass fiber mat has glass fibers wherein the glass fibers have a residue of a chemical treating composition having a carrier and film forming material, and compatible coupling agent.

13. Coating applicator of claim 6, wherein the multilayered mat is a needled fabric having the first layer of glass fiber mat needled with the second layer of mat.

14. Coating applicator of claim 6, wherein the relative thickness of the two mat layers in the applicator varies between about 5 and 95 percent of the total thickness.

15. Coating applicator of claim 14, wherein the relative thickness of the two mat layers varies from about 75 to 25 to about 50 to 50 percent of the first layer of mat to the second layer of mat based on the total thickness of the multiple layered mat.

16. Coating applicator of claim 6, wherein the first and second mat layers have arrangements of the fibers and fibrous material within each mat layer provided by sufficient entanglements of the fibers and fibrous material to allow for pickup and discharge of the coating from the applicator but not too many entanglements to give a packing factor to preclude capillary action of the coating in the multilayered mat.

17. Coating applicator of claim 6, wherein the first and second mat layers have an arrangement of the fibers and fibrous material in each mat layer provided by sufficient chemical integrity to allow for pickup and discharge of the coating from the applicator but not to have too much chemical integrity to give a packing factor to preclude the capillary action of the coating in the multilayered mat.

18. Coating applicator of claim 6, wherein the first and second mat layers have arrangements of the fibers and fibrous material within each mat layer which is provided by sufficient entanglements and sufficient chemical integrity to allow for pickup and discharge of the coating from the applicator, but not too many entanglements nor too much chemical integrity to give a packing factor to preclude the capillary action of the coating in the mat.

19. Applicator of claim 1, wherein the core is cylindrical and the mat is attached to the outer surface of the core to form a roller applicator which is adaptable for holding by means of a handle.

20. Applicator of claim 1, wherein the core is a planar sheet which is flat and has two surfaces and the mat is attached to one surface of the core and the other surface of the core is attached to a backing member suitable for engagement with a handle.

21. Applicator of claim 20, wherein the core is a sponge-like substance.

22. Applicator of claim 1, wherein the filament diameter of the fibers in the mat ranges from submicron to about 30 microns.

23. Applicator of claim 22 wherein the filament diameter ranges from about 5 to about 20 microns.

24. Coating applicator of claim 1, wherein the core is a material selected from paper, cardboard, polymeric impregnated paper, and polymeric materials.

25. Coating applicator of claim 1, wherein the core is mounted on a handle so that the core can be removed.

26. Coating applicator of claim 1, wherein the glass fiber mat is engaged to the core by an adhesive.

27. Coating applicator of claim 26, wherein the chemical composition also has a lubricant.

28. Applicator of claim 1, wherein the core is mounted to the outside of a mitt.

29. Applicator of claim 1, wherein the mat has a thickness in the range of about 0.125 inches to about 2 inches.

30. Coating applicator of claim 1, wherein the thickness of the mat allows for the development of a coating reservoir when a coating is applied to the mat.

* * * * *